US005647829A

United States Patent [19]

Rivas

[11] Patent Number: 5,647,829

[45] Date of Patent: Jul. 15, 1997

[54] ABDOMINAL EXERCISE APPARATUS AND METHOD

[76] Inventor: Andrew R. Rivas, 1767 Woodbine Pl., Oceanside, Calif. 92054

[21] Appl. No.: 428,714

[22] Filed: Apr. 25, 1995

[51] Int. Cl.[6] ..... A63B 21/00

[52] U.S. Cl. ..... 482/142; 482/140; 482/148

[58] Field of Search ..... 5/630, 633, 632, 5/652, 481, 420; D6/601, 595, 596, 604; 482/142, 96, 140, 148

[56] References Cited

U.S. PATENT DOCUMENTS

| | | | |
|---|---|---|---|
| D. 203,251 | 12/1965 | Barber | D6/601 |
| D. 233,200 | 10/1974 | Madl | D6/546 |
| D. 236,287 | 8/1975 | McNair | D6/596 |
| D. 319,553 | 9/1991 | Main | D6/601 |
| D. 335,235 | 5/1993 | Hildreth | D6/601 |
| D. 342,411 | 12/1993 | Graebe | D6/596 |
| 2,780,472 | 2/1957 | Weldon . | |
| 4,424,599 | 1/1984 | Hannauche | 5/436 |
| 5,261,865 | 11/1993 | Trainor | 482/95 |
| 5,474,513 | 12/1995 | Carlesimo et al. | 482/140 |

FOREIGN PATENT DOCUMENTS

| | | | |
|---|---|---|---|
| 2660187 | 10/1991 | France | 5/630 |
| 3326078 | 1/1985 | Germany | 482/140 |

*Primary Examiner*—Jerome Donnelly
*Attorney, Agent, or Firm*—Baker, Maxham, Jester & Meador

[57] ABSTRACT

An abdominal exercise cushion for enabling the performance of safe and effective abdominal exercises, said cushion, comprises a yieldable back support device comprising pillow-like main body portion having an anchoring panel extending from a front side of the main body portion, the main body portion having a three dimensional configuration with a base surface and a back engaging support surface with a height sufficient to at least engaging a persons lower back for yieldably engaging and supporting a person in a partially backwardly inclining position, the anchoring panel formed of a pliable fabric panel secured along a front edge of the main body portion between the base surface and the support surface and adapted to be positioned to the front side of the main body for sitting on while inclining on said main body portion.

5 Claims, 1 Drawing Sheet

ABDOMINAL EXERCISE APPARATUS AND METHOD

BACKGROUND OF THE INVENTION

The present invention relates to exercise devices and methods and pertains particularly to an improved apparatus and method for easy, simple and effective abdominal exercises.

Strong abdominal muscles are desirable for health reasons, as well as enhanced appearance. The abdominal muscles help support the spine and help prevent and alleviate certain lower back problems. The sit up exercise is the traditional exercise for strengthening the abdominal muscles. The traditional sit up exercise is carried out by lying flat on a floor with the knees slightly bent and rising to a sitting position using only the abdominal muscles. This form of exercise puts undue strain on the lower back and is difficult for most people to perform. Moreover it is not recommended for people having lower back problems. For this reason, the abdominal crunch is the recommended exercise for most people.

The abdominal crunch is performed by lying flat on the back with knees bent and rolling or curling up to a position wherein the upper back is raised from the floor by flexing the abdominal muscles. This position is held for a few moments and then the abdominal muscles are relaxed to roll back down to a flat position. This is repeated for a prescribed number of times. This procedure can also put a undue strain on the lower back for some people and can possibly result in injury.

There is a need for a safer and effective method and apparatus for performing abdominal exercises.

SUMMARY OF THE INVENTION

An abdominal exercise cushion for enabling the performance of safe and effective abdominal exercises comprises an elastic pillow-like cushion or structure having a main body portion and a seat portion, said main body portion having a three dimensional configuration with a height for yieldably engaging and supporting a person in a partially backwardly reclining position, said seat portion formed of a panel secured along an edge of said main body portion and positioned to one side of said main body for sitting on while reclining on said main body portion.

BRIEF DESCRIPTION OF THE PREFERRED EMBODIMENTS

The above and other objects and advantages of the present invention will become apparent from the following description when read in conjunction with the accompanying drawings wherein:

FIG. 1 is a perspective view of a preferred embodiment of the invention; and FIG. 2 is a side elevation view of the embodiment of Fig. 1 shown in use.

DETAILED DESCRIPTION OF THE PREFERRED EMBODIMENTS

Figure 1:
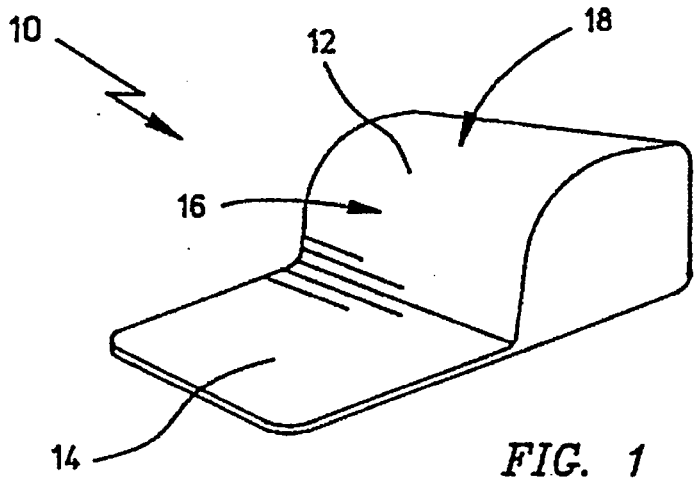
Figure 2:
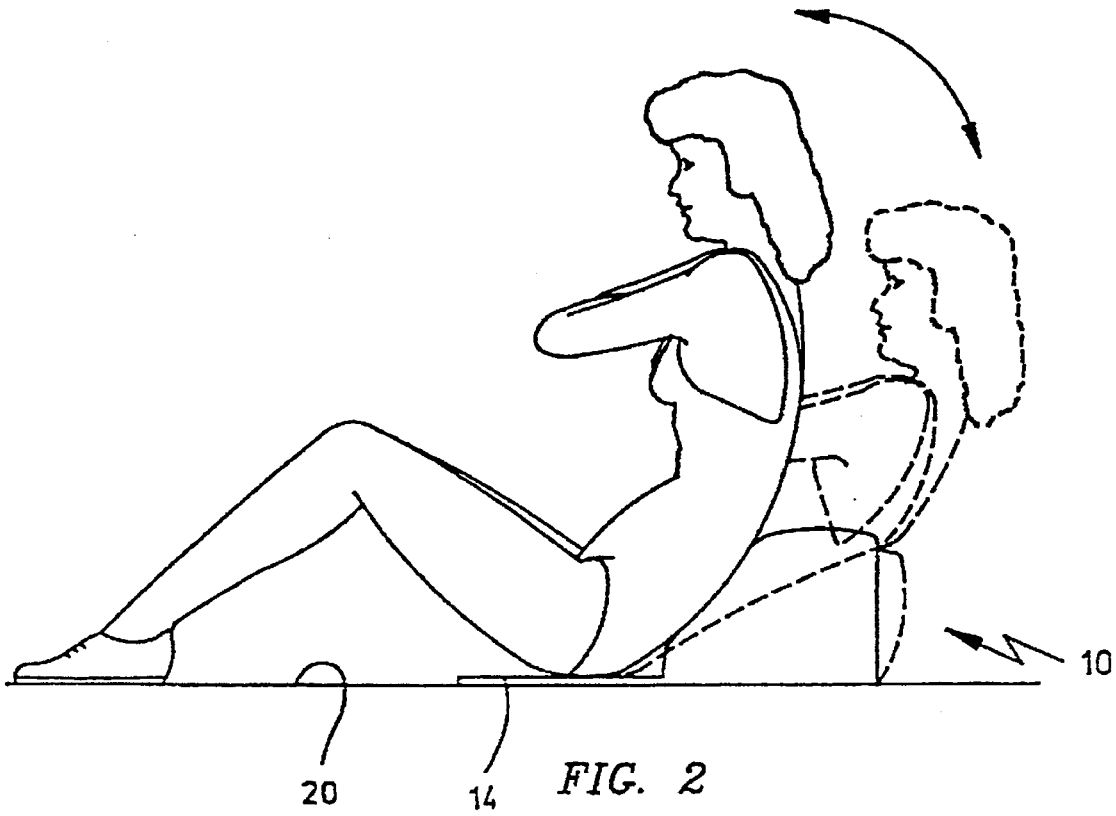

Referring to FIGS. 1 and 2 of the drawing an abdominal exercise cushion in accordance with a preferred embodiment of the present invention is illustrated and designated generally by the numeral 10. The cushion comprises a pillow-like main body portion 12 having a somewhat generally rectangular box-like configuration with generally rectangular top, bottom, front, back and side surfaces, and a rounded upper front corner between a front surface 16 and a top surface 18. The bottom surface is generally flat planar and adapted to rest on a planar support surface. The front and back surfaces are generally parallel, although the front may tilt slightly toward the back, and extend upward from the bottom to the top generally planar horizontal surface. The side surfaces are likewise generally parallel and extend upward from the bottom to the top surface. A combination seat and anchoring panel 14 having a length about equal to the length of the main body portion is secured along a front lower edge of the front surface 16 of the main body portion and extends forward for lying flat on a planar support surface 20. This forms an anchoring panel or device and a seat cushion for a person to sit on while performing the exercises.

The main body portion 14 is preferably a block of resilient material, such as a foam, having the appropriate dimensions and firmness to support a body in a partially reclining position, as shown in FIG. 2, while performing abdominal crunches. The term resilient means that the body of material yields under force or pressure and returns to its original shape when the force is removed. The main body portion preferably has dimension on the order of about 9–15 inches in length (fore to aft), about 8–14 inches in height, and approximately 14 inches in width. The cushion is preferably of a height to extend up to a position above the pelvic bone and just below mid-back of a person reclining against the cushion, such as illustrated in FIG. 2, for example. The dimensions will preferably vary in accordance with the height of the torso of the person utilizing it.

The main body portion is preferably a block of resilient foam rubber covered by a fabric, such as any suitable woven or non-woven materials suitable for upholstery and the like. These include, but are not limited to, cloth, leather, plastic and other similar materials.

The main body portion 12 forms a continuous back engaging support surface, including a front face 16 and a top face or surface 18, with a rounded corner or transition therebetween. This forms an extended support surface without seams that may tend to detract from the comfort of the cushion.

The foam making up the main body portion preferably has a hardness or firmness of from about 1.9 pounds per square inch and 3 pounds per square inch, which will, of course, vary depending upon the size and weight of the individual for which it is designed. The preferred firmness is about 1.9 pounds per square inch, which is considered medium firmness. The foam is preferably sufficient to at least partially support the person during abdominal crunches, wherein the individual rolls upward from a relaxed, inclined position of about 30°, as shown in phantom in FIG. 2 up to a somewhat vertical position of about 60° as shown in solid lines in FIG. 2. The cushion is preferably firm enough to support the person in the position substantially as shown in phantom in FIG. 2.

The panel 14 is preferably padded with a thin layer of foam to support the buttocks so that the tailbone of a person using the cushion is preferably supported off the surface on which the cushion is resting. The anchoring panel 14 may have any suitable shape sufficient to support the buttocks and anchor the pillow in position on a suitable planar surface. For example, it may have spaced, padded portions with a non-padded portion between.

In use, a person desiring to utilize a cushion in accordance with the invention for conducting abdominal exercises in accordance with the invention, selects a cushion of the appropriate dimension and firmness. The cushion is placed on a support surface, as illustrated in FIG. 2, wherein the anchoring panel is extended forward to provide a cushion on which the person sits to support the buttocks and to anchor the cushion. The person sits on the panel 14 with the lower back against the front face 16 of the cushion with legs and knees bent and preferably in a partially backward reclining position, as shown in FIG. 2. In the preferred arrangement, the person crosses the arms above the chest and alternately leans backward as shown in phantom and rolls forward, pulling forward with the abdominal muscles to a somewhat upright position as shown in solid lines in FIG. 2. This is a preferred form for the average person. However, a person in excellent physical condition (with strong abdominal muscles) may preferably cross the arms above and behind the head (not shown) to add further resistance to the crunch.

The exercise in this manner has been found to be safe and effective for individual with minor lower back problems. The cushion provides varying support for the upper body during the movement between the forwardmost position and the rearwardmost position. These positions preferably fall between the range of thirty degrees to sixty degrees from the horizontal and/or vertical.

While I have illustrated and described my invention by means of specific embodiments, it is to be understood that numerous changes and modifications may need to be made therein without departing from the scope or spirit of the invention, as defined in the appended claims.

We claim:

1. An abdominal exercise cushion for enabling the performance of safe and effective abdominal exercises, said cushion comprising:

an elastic back support device comprising a pillow-like main body portion and an anchoring panel extending from a front of said main body portion, said main body portion having a three dimensional configuration with a generally planar base surface adapted to rest on a horizontal support surface, opposing side surfaces, a back surface and a front surface extending upward to a top surface, said front surface defining a back engaging support surface extending upward from said base surface at said front, said foam block having a length of between nine to fifteen inches and a height of between eight to twelve inches, thereby providing a support surface having a height sufficient to engage a person above the person's pelvis and below about mid back when in about a sixty degree inclined position from the vertical and to support the person's upper body inclined at about a thirty degree position from the horizontal, with a height sufficient for yieldably engaging a lower back of a person and supporting said person in a partially backwardly inclining position, said anchoring panel having top and bottom generally parallel surfaces and formed of a pliable fabric panel secured along an edge of said front of said main body portion between said base surface and said support surface and adapted to be positioned to said front of said main body for sitting on while inclining on said main body portion.

2. An exercise cushion according to claim 1 wherein said support surface is covered by a pliable panel of fabric secured along a bottom edge to a forward edge of said bottom surface and along a top edge to a top edge of a rear surface.

3. An exercise cushion according to claim 1 wherein said anchoring panel is padded with up to about one inch of foam.

4. An improved method of abdominal exercise, comprising the steps of:

selecting an elastic support cushion as defined in claim 1;

placing said support cushion on a planar support surface positioning said anchoring panel to said front of said main body;

sitting on said anchoring panel on said support surface adjacent said and reclining against said cushion; and, performing abdominal crunches while at least partially supported by said cushion.

5. A method of according to claim 4 wherein performing abdominal crunches while at least partially supported by said cushion comprises performing said crunches within a range of angles of between about thirty and sixty degrees.

* * * * *